US008239120B2

(12) United States Patent
Mallebrein et al.

(10) Patent No.: US 8,239,120 B2
(45) Date of Patent: Aug. 7, 2012

(54) METHOD AND DEVICE FOR OPERATING AN INTERNAL COMBUSTION ENGINE

(75) Inventors: Georg Mallebrein, Korntal-Muenchingen (DE); Laurent Nack, Stuttgart (DE); Oliver Pechan, Gerlingen (DE); Pierre-Yves Crepin, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 749 days.

(21) Appl. No.: 12/435,560

(22) Filed: May 5, 2009

(65) Prior Publication Data

US 2009/0281710 A1 Nov. 12, 2009

(30) Foreign Application Priority Data

May 8, 2008 (DE) ..... 10 2008 001 670

(51) Int. Cl.
*F02D 41/40* (2006.01)
*F02M 41/00* (2006.01)
*F02B 3/00* (2006.01)

(52) U.S. Cl. ..... 701/104

(58) Field of Classification Search ..... 701/104, 701/103, 105, 109, 102, 115; 123/456, 478, 123/480, 673, 676
See application file for complete search history.

(56) References Cited

U.S. PATENT DOCUMENTS 6,119,656 A * 9/2000 Schmidt ..... 123/456
6,675,787 B2 * 1/2004 Damitz et al. ..... 701/109

* cited by examiner

*Primary Examiner* — Hieu T Vo
(74) *Attorney, Agent, or Firm* — Kenyon & Kenyon LLP

(57) ABSTRACT

A method and a device for operating an internal combustion engine to perform a lambda regulation without using a lambda sensor. Fuel is injected for combustion in a combustion chamber of the internal combustion engine. A first quantity of the internal combustion engine is ascertained, which allows a conclusion to be drawn about the behavior of an output quantity of the internal combustion engine, in particular of a torque.

16 Claims, 5 Drawing Sheets

METHOD AND DEVICE FOR OPERATING AN INTERNAL COMBUSTION ENGINE

CROSS REFERENCE

This application claims the benefit under 35 U.S.C. §119 of German Patent Application No. DE 102008001670.5 filed on May 8, 2008, which is expressly incorporated herein by reference in its entirety.

FIELD OF THE INVENTION

The present invention is directed to a method and a device for operating an internal combustion engine.

BACKGROUND INFORMATION

Conventional methods and devices for operating an internal combustion engine include the injection of fuel for combusting in a combustion chamber of the internal combustion engine, where a first quantity of the internal combustion engine is ascertained which allows a conclusion to be drawn as to the behavior of an output quantity of the internal combustion engine, in particular of a torque. As an example for ascertaining such a first quantity of the internal combustion engine, the combustion chamber pressure is ascertained, from which a conclusion may be drawn on the behavior of the torque of the internal combustion engine.

SUMMARY

A method and device according to an example embodiment of the present invention may have the advantage that:

a) a first fuel quantity to be injected is predefined;

b) a first value of the first quantity is ascertained, which results from a fuel injection according to the first fuel quantity to be injected;

c) the fuel quantity to be injected is modified from the first fuel quantity to be injected in relation to an air quantity to be supplied to the internal combustion engine;

d) a second value of the first quantity is ascertained, which results from the change in the fuel quantity to be injected;

e) the first value of the first quantity is compared to the second value of the first quantity, and f) as a function of the comparison result, a value for an air/fuel mixture ratio that prevailed prior to the change in the fuel quantity to be injected for the first fuel quantity to be injected is ascertained independently of a measured value of a sensor measuring the oxygen level in the exhaust gas.

In this way, the air/fuel mixture ratio may be ascertained without using a lambda sensor. The costs for a lambda sensor may thus be saved or for an operating state of the internal combustion engine in which an existing lambda sensor is not yet operational, the air/fuel mixture ratio may still be ascertained. In this way, for example, fuel releasing high amounts of gas from the engine oil through a crankcase vent may be detected and corrected.

It may be advantageous if steps a) through f) are performed repeatedly, the first fuel quantity to be injected in step a) being set equal to the fuel quantity to be injected achieved in step c) in the previous run through steps a) through f). In this way, a plausibility check of the ascertained air/fuel mixture ratio is possible, so that the air/fuel mixture ratio may be determined with high reliability.

It may be advantageous that an error is detected if, after a plurality of successive runs through steps a) through f), different results for the air/fuel mixture ratio are ascertained without a basic injected amount having been corrected. In this way, error detection or detection of interfering influences is possible in a simple and uncomplicated manner during ascertainment of the air/fuel mixture ratio.

Another advantage may result if the ascertained air/fuel mixture ratio is compared with a predefined air/fuel mixture ratio and if, depending on the comparison result, the value of the first fuel quantity predefined prior to the first run through steps b) through f) is corrected as a basic injected amount in such a way that the ascertained air/fuel mixture ratio approaches the predefined air/fuel mixture ratio. This permits regulating the air/fuel mixture ratio even without using a lambda sensor.

The air/fuel mixture ratio may be ascertained according to the present invention in a particularly simple manner by increasing the fuel quantity to be injected in step c) and, in the case of a comparison result in step e) following the increase in the fuel quantity to be injected showing an increase in the output quantity of the internal combustion engine, the conclusion is drawn that a lean air/fuel mixture ratio prevailed prior to the increase in the fuel quantity to be injected.

The air/fuel mixture ratio may be ascertained in a similarly simple manner if the fuel quantity to be injected in step c) is reduced and, in the case of a comparison result in step e) following the reduction in the fuel quantity to be injected showing a reduction in the output quantity of the internal combustion engine, the conclusion is drawn that a lean air/fuel mixture ratio prevailed prior to the increase in the fuel quantity to be injected.

The air/fuel mixture ratio may be ascertained in a similarly simple manner if the fuel quantity to be injected is increased in step c) and, in the case of a comparison result in step e) following the increase in the fuel quantity to be injected showing a reduction in the output quantity of the internal combustion engine, the conclusion is drawn that a rich air/fuel mixture ratio prevailed prior to the increase in the fuel quantity to be injected.

The air/fuel mixture ratio may be ascertained in a similarly simple manner if the fuel quantity to be injected is reduced in step c) and, in the case of a comparison result in step e) following the reduction in the fuel quantity to be injected showing an increase in the output quantity of the internal combustion engine, the conclusion is drawn that a rich air/fuel mixture ratio prevailed prior to the increase in the fuel quantity to be injected.

The air/fuel mixture ratio may be ascertained in a similarly simple manner if, in the case of a comparison result in step e) following the change in the fuel quantity to be injected in step c) showing no change in the output quantity of the internal combustion engine, the conclusion is drawn that a stoichiometric air/fuel mixture ratio prevailed prior to the increase in the fuel quantity to be injected.

It is furthermore advantageous if a position of an actuator, preferably of a throttle valve in an air supply to the internal combustion engine, is selected as the first quantity of the internal combustion engine and if a movement of the actuator in the opening direction is detected when the output quantity of the internal combustion engine is reduced. This permits detection of a change in the output quantity of the internal combustion engine in a simple and reliable manner.

A simple detection of a change in the output quantity of the internal combustion engine may also be achieved by selecting an ignition angle or an ignition angle efficiency as a relationship between an instantaneous ignition angle and an optimum ignition angle for the combustion as the first quantity of the internal combustion engine, and an ignition angle retard or a reduction in the ignition angle efficiency is recognized when the output quantity of the internal combustion engine is reduced.

A change in the output quantity of the internal combustion engine may also be ascertained in a simple manner by selecting a measured or modeled torque of the internal combustion engine which corresponds to the output quantity of the internal combustion engine as the first quantity of the internal combustion engine.

A change in the output quantity of the internal combustion engine may also be ascertained in a particularly simple manner by selecting a quantity characterizing a combustion, preferably a combustion chamber pressure, as the first quantity of the internal combustion engine, and by ascertaining a change in the output quantity of the internal combustion engine as a function of a behavior of the quantity characterizing the combustion.

It is furthermore advantageous if the first quantity is set to a predefined value, in particular of an idling regulation, within a regulation of a second quantity of the internal combustion engine. This permits ascertaining the air/fuel mixture ratio in a particularly simple, reliable, and uncomplicated manner.

It is furthermore advantageous if the air/fuel mixture ratio is ascertained according to steps a) through f), in particular during a cold start of the internal combustion engine, at least while a lambda sensor of the internal combustion engine is not operational. This permits ascertaining the air/fuel mixture ratio even during an operating state of the internal combustion engine in which the lambda sensor is not operational, for example, because it is defective or cannot be heated due to water deposits.

BRIEF DESCRIPTION OF THE DRAWINGS

An exemplary embodiment of the present invention is shown in the figures and explained in greater detail below.

DETAILED DESCRIPTION OF EXAMPLE EMBODIMENTS

Figure 1:
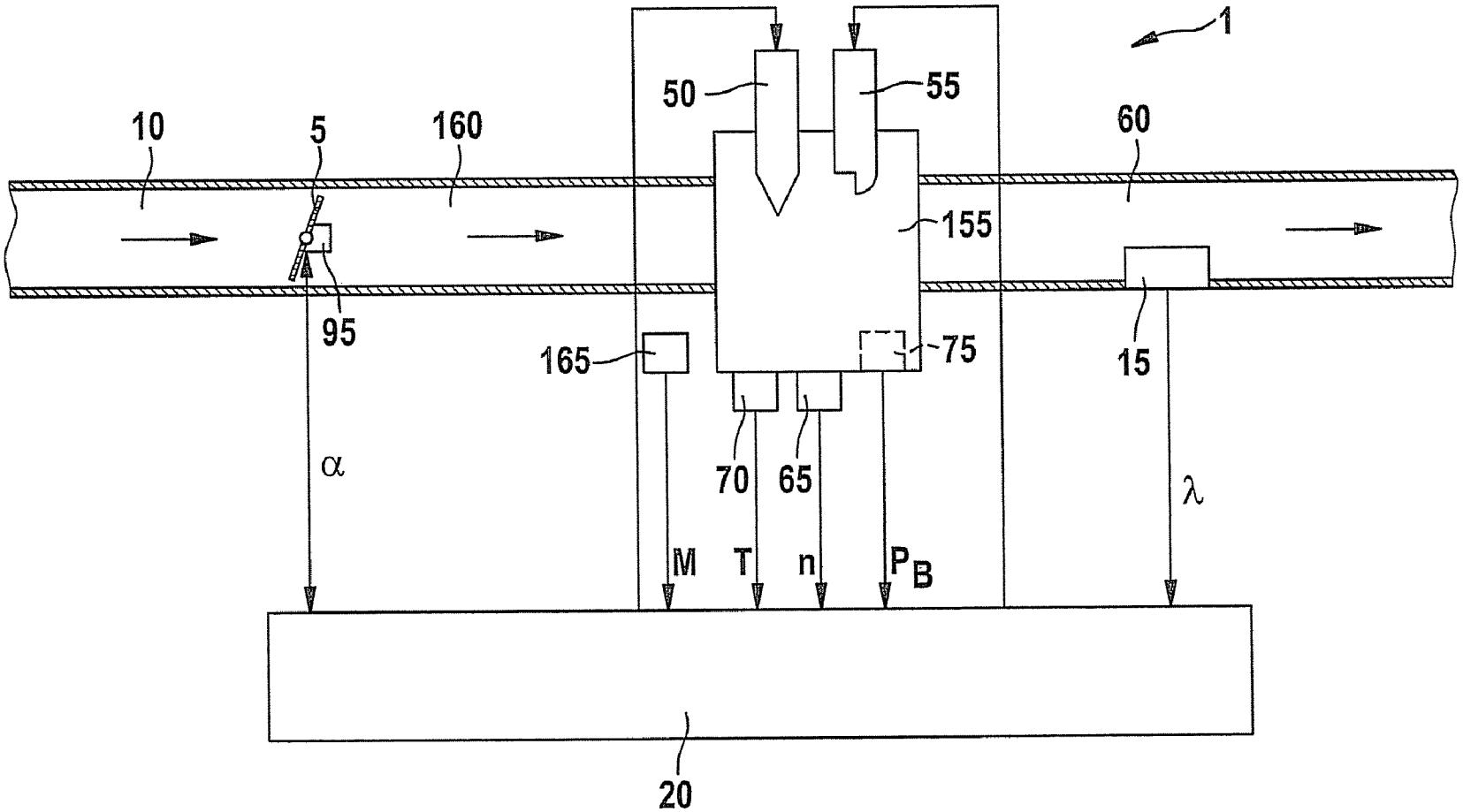
FIG. 1 shows a schematic view of an internal combustion engine.

In FIG. 1, reference numeral 1 identifies an internal combustion engine, which may be designed as a gasoline engine or a diesel engine, for example. In the following it will be assumed, as an example, that internal combustion engine 1 is designed as a gasoline engine. Fresh air may be supplied to a combustion chamber 155 of gasoline engine 1 via an air supply 10. An actuator 5, which is designed as a throttle valve, for example, is situated in air supply 10. The position of throttle valve 5 affects the air mass flow supplied to combustion chamber 155 via air supply 10. The position of throttle valve 5 may be set by an engine controller 20, for example, as a function of an input by the driver, who appropriately operates an accelerator pedal. It is assumed here that gasoline engine 1 drives a vehicle. A position sensor 95, for example, in the form of a potentiometer, is situated in the area of throttle valve 5 and is used for measuring instantaneous position $\alpha$ of the throttle valve, which is transmitted to engine controller 20 for further processing. Fuel is injected directly into the combustion chamber via an injector 50, the time and duration of injection being also predefined by engine controller 20, for example, for setting a desired air/fuel mixture ratio. Alternatively, the fuel may also be injected into air supply 10 and there, specifically, into the intake manifold labeled with reference numeral 160, downstream from throttle valve 5. The air/fuel mixture is ignited in combustion chamber 155 by a spark plug 55, whose ignition time is also set by engine controller 20. The exhaust gas formed in combustion chamber 155 by the combustion of the air/fuel mixture is expelled in an exhaust tract 60. A lambda sensor 15, which measures the oxygen level in the exhaust gas and supplies it as the instantaneous $\lambda$ value to engine controller 20, is situated in exhaust tract 60. The movement of a crankshaft driven by gasoline engine 1 is detected by a rotational speed sensor 65 in the form of instantaneous engine speed n, which is also relayed to engine controller 20. Furthermore, a temperature sensor 70 is situated in combustion chamber 155, which measures the instantaneous engine temperature T and relays it to engine controller 20. Temperature sensor 70 may detect the engine temperature, for example, in the form of the cooling water temperature or the oil temperature or the cylinder head temperature. In the present example, it is assumed that combustion chamber 155 is the combustion chamber of a cylinder of gasoline engine 1; gasoline engine 1 may have additional cylinders. A combustion chamber pressure sensor 75, which measures the instantaneous combustion chamber pressure $p_B$ and relays it to engine controller 20, is optionally situated in combustion chamber 155.

Furthermore, a torque sensor 165, which ascertains the instantaneous torque of gasoline engine 1 and relays it to engine controller 20, may be optionally situated in the area of an output shaft (not illustrated) of gasoline engine 1. Torque sensor 165 ascertains instantaneous torque M in a manner known to those skilled in the art, for example, by using a strain gage on the output shaft.

Figure 2:
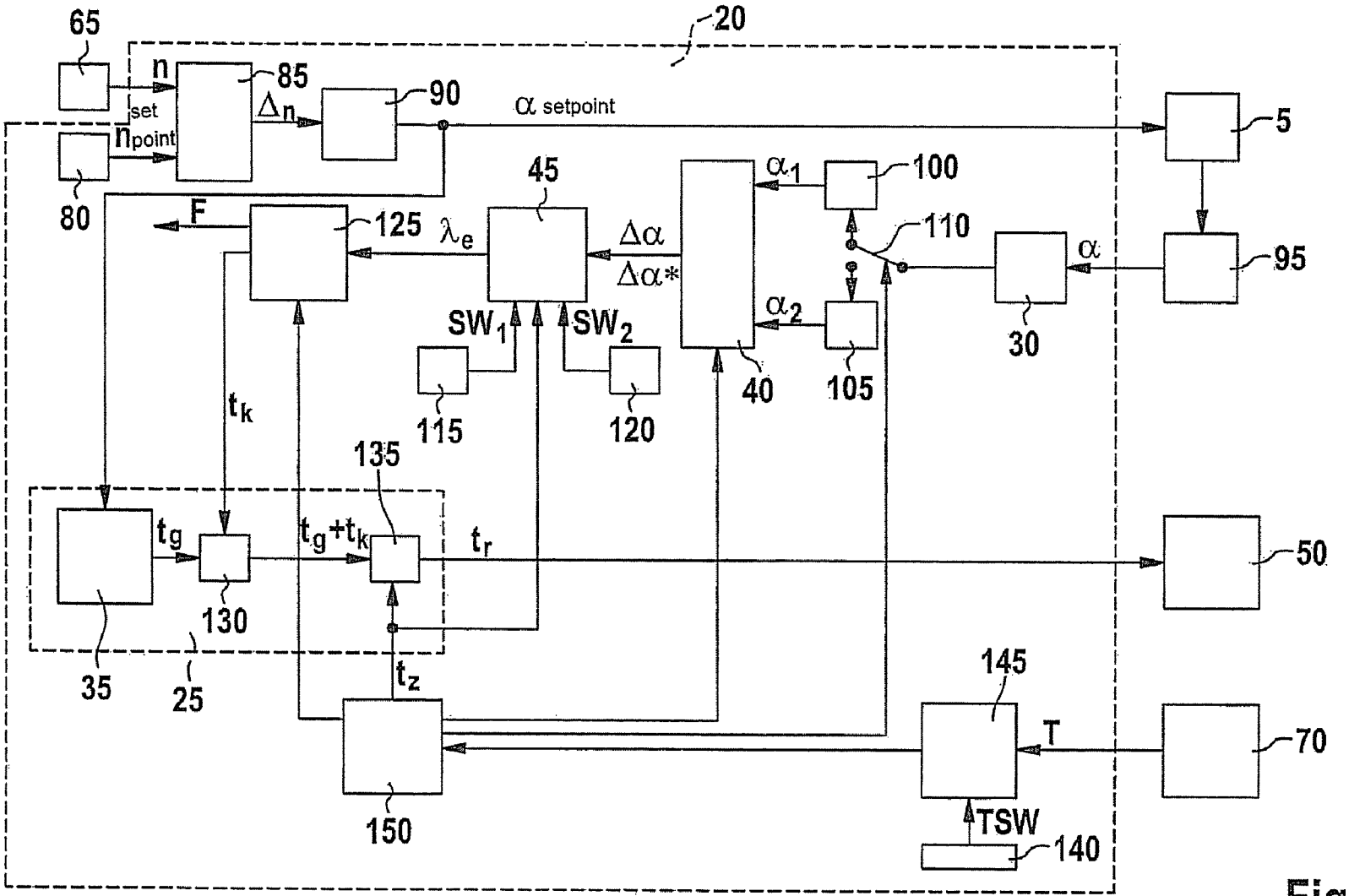
FIG. 2 shows a function diagram of an example construction of a device according to the present invention.

FIG. 2 shows a function diagram of an example construction of a device according to the present invention, and also illustrates the sequence of a method according to the present invention as an example. The device may be implemented, for example, as software and/or hardware in engine controller 20. In the following, it is assumed, for the sake of simplicity, that the device corresponds to engine controller 20, FIG. 2 showing only those functions of engine controller 20 which concern the device and method according to the present invention.

Instantaneous engine speed n is supplied by rotational speed sensor 65 to a first comparator unit 85 of engine controller 20. A setpoint value nsetpoint for the engine speed, for example, for the idling speed of gasoline engine 1, is saved in a first memory 80. Setpoint value nsetpoint is also supplied to first comparator unit 85. First comparator unit 85 forms difference $\Delta n$ between instantaneous engine speed n and setpoint value nsetpoint for the engine speed.

$$\Delta n = n - n\text{setpoint} \tag{1}$$

First comparator unit 85 supplies formed difference $\Delta n$ to an idling controller 90, which adjusts the degree of opening or the position of throttle valve 5 in the idling operating state of gasoline engine 1 and forms, as a function of supplied difference $\Delta n$, a setpoint value $\alpha$setpoint for the position of throttle valve 5 in such a way that instantaneous engine speed n approaches setpoint value nsetpoint for the engine speed.

Idling controller 90 controls throttle valve 5 according to setpoint value αsetpoint. Potentiometer 95 detects instantaneous throttle valve angle or instantaneous position α of the throttle valve and relays it to a first ascertaining unit 30 of engine controller 20. First ascertaining unit 30 detects instantaneous position α of throttle valve 5 and relays it, depending on the position of a controlled switch 110, to a first memory 100 or a second memory 105. A first instantaneous position α1 of throttle valve 5 is stored in first memory 100 and a second instantaneous position α2 is stored in second memory 105. First instantaneous position α1 of throttle valve 5 is relayed from first memory 100 to a second comparator unit 40. Second instantaneous position α2 of throttle valve 5 is relayed from second memory 105 also to second comparator unit 40. Second comparator unit 40 forms the difference Δα between first instantaneous position α1 and second instantaneous position α2 of throttle valve 5 as follows:

$$\Delta\alpha=\alpha 2-\alpha 1 \quad (2)$$

Second comparator unit 40 relays the formed difference Δα of the positions of throttle valve 5 to a second ascertaining unit 45. Second ascertaining unit 45 receives a first predefined threshold value SW1 from a first threshold value memory 115, and a second predefined threshold value SW2 from a second threshold value memory 120. Second ascertaining unit 45 forms an substitute value $\lambda_e$ for the air/fuel mixture ratio prevailing in combustion chamber 155 as a function of the supplied difference Δα of the positions of throttle valve 5, first predefined threshold value SW1, and second predefined threshold value SW2. Substitute value $\lambda_e$ for the air/fuel mixture ratio is relayed from second ascertaining unit 45 to a first correction unit 125, which forms a correction period $t_k$ for a predefined injection period of injector 50 as a function of substitute value $\lambda_e$ for the air/fuel mixture ratio. Correction period $t_k$ is supplied from first correction unit 125 to a trigger unit 25 and there to a first addition element 130. A basic injection period $t_g$ is supplied as the second input quantity from a selection unit 35 of trigger unit 25 to first addition element 130. Sum $t_g+t_k$ of the basic injection period $t_g$ and correction injection period $t_k$ resulting at the output of first addition element 130 are supplied to a second addition element 135 of trigger unit 25 and there added to an additional injection period $t_z$ of a second correction unit 150. The resulting sum $t_r$ at the output of second addition element 135 is therefore obtained as follows:

$$t_r=t_g+t_k+t_z \quad (3)$$

Injector 50 is then triggered according to the resulting injection period $t_r$ at the output of second addition element 135. Furthermore, second correction unit 150 triggers first controlled switch 110. Signal T of temperature sensor 70 is supplied to a third comparator unit 145 of engine controller 20 and there compared to a temperature threshold value TSW stored in a third threshold value memory 140. An output signal of third comparator unit 145 is formed, which triggers second correction unit 150, as a function of the comparison result in third comparator unit 145.

Figure 5:
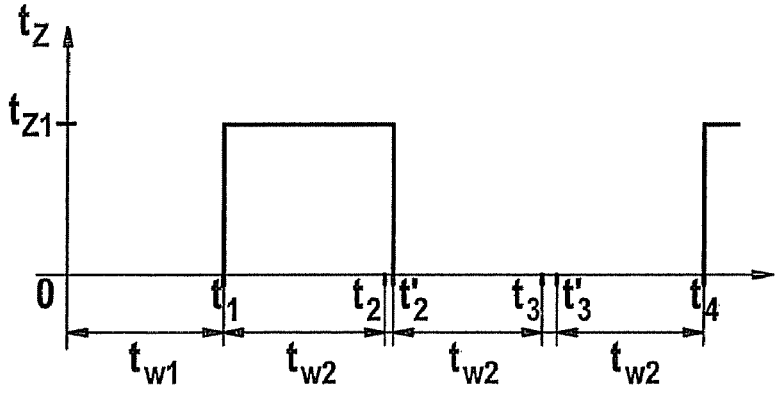
FIG. 5 shows a sequence of an additional injection period over time.

The mode of operation of the function diagram illustrated in FIG. 2 is as follows:

Temperature threshold value TSW is calibrated, for example, on a test bench, in such a way that for instantaneous engine temperatures T greater than or equal to temperature threshold value TSW, lambda sensor 15 is reliably operational, and for instantaneous engine temperatures T less than the predefined temperature threshold value TSW, lambda sensor 15 is reliably non-operational. For instantaneous engine temperatures T greater than or equal to temperature threshold value TSW, third comparator unit 145 outputs a set signal at its output; otherwise it outputs a reset signal. Instantaneous engine temperatures T below temperature threshold value TSW occur, for example, during cold start of gasoline engine 1. It is now assumed as an example that at a point in time t=0 a cold start of gasoline engine 1 is initiated. At point in time t=0, instantaneous engine temperature T is therefore below temperature threshold value TSW, and third comparator unit 145 outputs a reset signal at its output. As long as second correction unit 150 receives a reset signal from third comparator unit 145, it outputs value 0 as additional injection period $t_Z$ and controls controlled switch 110 to connect the output of first ascertaining unit 30 to first memory 100. FIG. 5 shows additional injection period $t_Z$ over time t as an example.

If gasoline engine 1 is idling during the cold start, idling controller 90 is active and the position of throttle valve 5 is set according to setpoint value αsetpoint for the position of the throttle valve by the output of idling controller 90. In the following it is assumed as an example that during the cold start of gasoline engine 1, idling controller 90 is active. Setpoint value αsetpoint of idling controller 90 is supplied to selection unit 35. Selection unit 35 ascertains as a function of setpoint value αsetpoint and a predefined air/fuel mixture ratio $\lambda_{setpoint}$ a fuel quantity to be injected and outputs the basic injection period $t_g$ required for that purpose. The predefined air/fuel mixture ratio may be, for example, a stoichiometric ratio with $\lambda_{setpoint}=1$. The actual value obtained for instantaneous position α of throttle valve 5 is transmitted by first ascertaining unit 30, via controlled switch 110, to first memory 100 and saved there. First memory 100 is overwritten with each new value for instantaneous position α of throttle valve 5 received from first ascertaining unit 30. After a first predefined waiting period $t_{w1}$, calibratable, for example, on a test bench, since the start of gasoline engine 1 at point in time t=0, a steady-state operating state of gasoline engine 1 is reliably attained in which instantaneous position α of throttle valve 5 has settled at a steady-state value. This settled value for instantaneous position α of throttle valve 5 is, at a first point in time $t_1$ which follows point in time t=0 after first predefined waiting period $t_{w1}$, in memory 100 as first instantaneous position α1 of throttle valve 5. At this first point in time $t_1$, second correction unit 150 causes controlled switch 110 to connect the output of first ascertaining unit 30 to second memory 105. As a result, steady-state first instantaneous position α1 of throttle valve 5 attained at first point in time $t_1$ may no longer be overwritten in first memory 100 by new values and is thus "frozen." At first point in time $t_1$, second correction unit 150 also causes additional injection period $t_z$ to be increased from the value 0 to a predefined value $t_{Z1}$. After a second predefined waiting period $t_{W2}$, which is in general less than first predefined waiting period $t_{w1}$, has elapsed since first point in time $t_1$, a possible change in the instantaneous position α of throttle valve 5 due to the increase in the additional injection period $t_z$, has settled again at a second point in time $t_2$. Therefore, the value saved in second memory 105 at second point in time $t_2$ for instantaneous position α of throttle valve 5 does not substantially change any more and is referred to in the following as second instantaneous position α2 of throttle valve 5. At second point in time $t_2$, second correction unit 150 then causes second comparator unit 40 to form the difference Δα=α2−α1 according to equation (2). In second ascertaining unit 45, difference Δα formed at second point in time $t_2$ is compared to first predefined threshold value SW1 and second predefined threshold value SW2. First predefined threshold value SW1 is positive, and second predefined threshold value SW2 is negative. Both predefined threshold values SW1, SW2 may be calibrated to the same absolute value, for example, on a test bench. If second ascertaining unit 45 determines that difference $\Delta\alpha$ ascertained at second point in time $t_2$ is positive, it recognizes that throttle valve 5 has opened further due to the increase in additional injection period $t_z$. If second ascertaining unit 45 additionally determines that difference $\Delta\alpha$ ascertained at second point in time $t_2$ is also greater than first predefined threshold value SW1, it establishes that the air/fuel mixture which prevailed in combustion chamber 155 from point in time t=0 to first point in time $t_1$ was on the rich side. Therefore, second ascertaining unit 45 sets substitute value $\lambda_e$ for the air/fuel mixture ratio at a value less than 1, for example, at the value $\lambda_e$=0.9. If, however, second ascertaining unit 45 determines that change $\Delta\alpha$ ascertained at second point in time $t_2$ is negative, it recognizes that throttle valve 5 has moved in the closing direction due to the increase in additional injection period $t_z$. If change $\Delta\alpha$ ascertained at second point in time $t_2$ is less than second predefined threshold value SW2, second ascertaining unit 45 recognizes that the air/fuel mixture ratio prevailing in combustion chamber 155 from time t=0 to first point in time $t_1$ was on the lean side. Second ascertaining unit 45 then sets substitute value $\lambda_e$ for the air/fuel mixture ratio at a value greater than 1, for example, at $\lambda_e$=1.1. However, if second ascertaining unit 45 establishes that difference $\Delta\alpha$ at point in time $t_2$ is between first predefined threshold value SW1 and second predefined threshold value SW2, i.e., SW1$\geqq\Delta\alpha\geqq$SW2, second ascertaining unit 45 recognizes that the position of throttle valve 5 has remained generally unchanged following the increase in additional injection period $t_z$, and thus the air/fuel mixture ratio in combustion chamber 155 was virtually stoichiometric from time t=0 to first point in time $t_1$. Second ascertaining unit 45 then sets substitute value $\lambda_e$ for the air/fuel mixture ratio at the value 1. First predefined threshold value SW1 and second predefined threshold value SW2 are calibrated, for example, on a test bench, in such a way that the two predefined threshold values SW1, SW2 form a tolerance range within which a change in the position of throttle valve 5 after a stoichiometric air/fuel mixture ratio in combustion chamber 155 from time t=0 to first point in time $t_1$ may be assessed. However, as soon as difference $\Delta\alpha$ is no longer situated between first predefined threshold value SW1 and second predefined threshold value SW2, i.e., the relationship SW1$\geqq\Delta\alpha\geqq$SW2 no longer applies, a stoichiometric air/fuel mixture from time t=0 to first point in time $t_1$ may no longer be assumed. The two predefined threshold values SW1, SW2 should have been calibrated in this regard on a test bench and/or in driving tests, for example, with the aid of the signal of lambda sensor 15 in exhaust tract 60, operated during the calibration.

Furthermore, predefined value $t_{Z1}$ for the additional injection period $t_z$ should be calibrated to be at least of a magnitude such that in the case of a non-stoichiometric air/fuel mixture ratio from time t=0 to first point in time $t_1$ results in a change $\Delta\alpha$ in the position of the throttle valve at second point in time $t_2$, which is no longer between first predefined threshold value SW1 and second predefined threshold value SW2, i.e., the relationship SW1$\geqq\Delta\alpha\geqq$SW2 no longer applies.

After ascertaining substitute value $\lambda_e$ for change $\Delta\alpha$ in the position of throttle valve 5 existing at second point in time $t_2$, second correction unit 150 triggers controlled switch 110 to connect the output of first ascertaining unit 30 to first memory 100 at a briefly, preferably immediately subsequent point in time $t'_2$, so that at second point in time $t_2$ second instantaneous position $\alpha_2$ stored in second memory 105 becomes "frozen." Starting at point in time $t'_2$, first memory 100 is now overwritten with the instantaneous values of position $\alpha$ of throttle valve 5. In addition, at point in time $t'_2$, additional injection period $t_z$ is reduced again by second correction unit 150 from predefined value $t_{Z1}$ to the value 0. A new settled condition is established from point in time $t'_2$ on after the elapse of second predefined waiting time $t_{w2}$ to a subsequent third point in time $t_3$. At third point in time $t_3$ instantaneous position $\alpha$ of throttle valve 5 basically no longer changes and the content of first memory 100 remains constant. At third point in time $t_3$, second correction unit 150 causes second comparator unit 40 to form difference $\Delta\alpha$ again, however, with a sign change in comparison with equation (2), so that the difference ascertained at third point in time $t_3$ is labeled in the following as $\Delta\alpha^*$ and ascertained as follows:

$$\Delta\alpha^*=\alpha1-\alpha2 \quad (4).$$

Second ascertaining unit 45 then compares difference $\Delta\alpha^*$ ascertained at third point in time $t_3$ to first predefined threshold value SW1 and second predefined threshold value SW2. For the case where second ascertaining unit 45 recognizes that $\Delta\alpha^*>$SW1, it recognizes a lean air/fuel mixture ratio in combustion chamber 155 for the period between first point in time $t_1$ and point in time $t'_2$ and sets substitute value $\lambda_e$ at a value greater than 1, for example, at 1.1. For the case where second ascertaining unit 45 recognizes that $\Delta\alpha^*<$SW2, second ascertaining unit 45 recognizes that a rich air/fuel mixture ratio prevailed in combustion chamber 155 between first point in time $t_1$ and point in time $t'_2$ and sets substitute value $\lambda_e$ at a value less than 1, for example, at 0.9. For the case where second ascertaining unit 45 recognizes that SW1$\geqq\Delta\alpha^*\geqq$SW2, second ascertaining unit 45 recognizes that a stoichiometric air/fuel mixture prevailed in combustion chamber 155 between first point in time $t_1$ and point in time $t'_2$ and sets substitute value $\lambda_e$ at the value 1.

Figure 6:
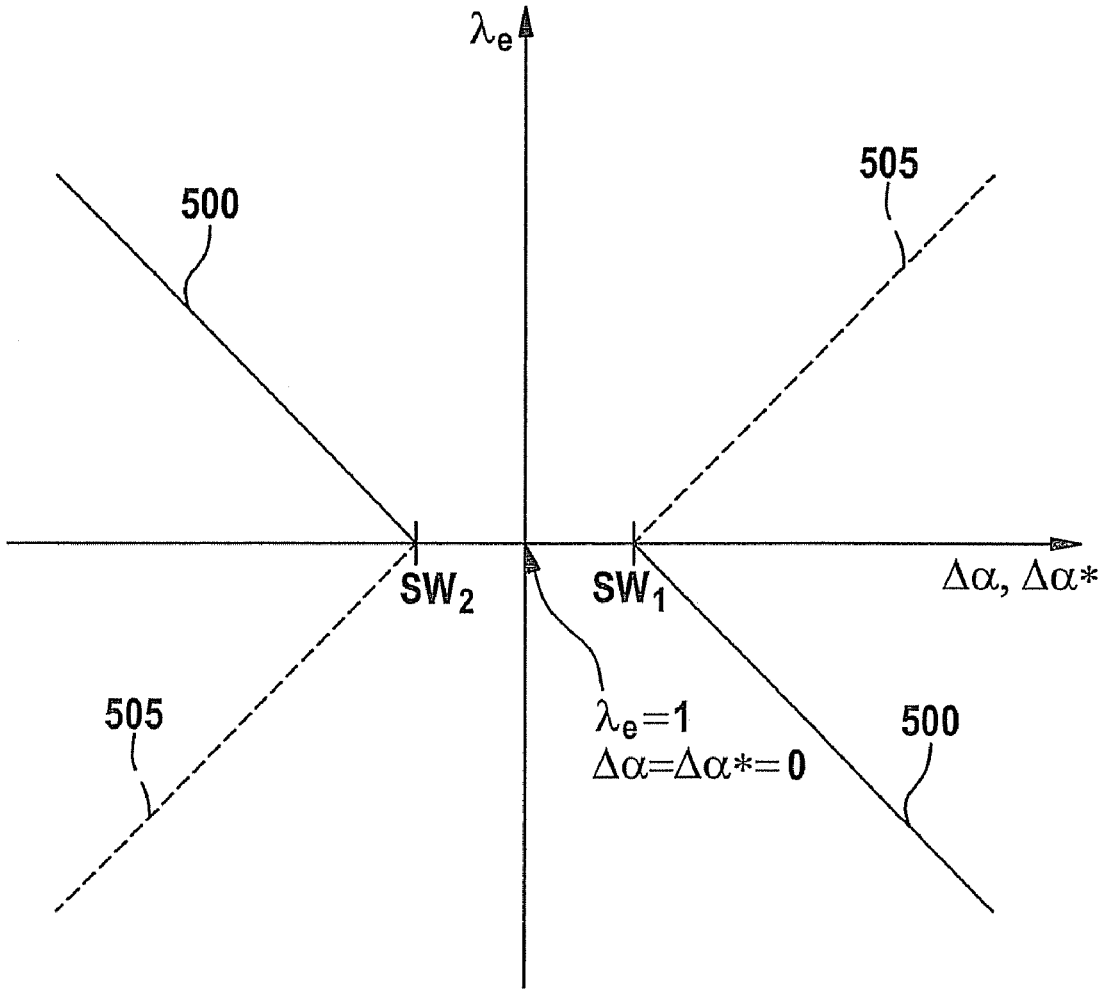
FIG. 6 shows a relationship between a change in a position of a throttle valve and an substitute value for an air/fuel mixture ratio.

FIG. 6 shows a predefined relationship between change $\Delta\alpha$, $\Delta\alpha^*$ in the position of throttle valve 5 and substitute value $\lambda_e$ ascertained in second ascertaining unit 45 as an example. Second ascertaining unit 45 ascertains substitute value $\lambda_e$ according to this predefined relationship, for example. Substitute value $\lambda_e$ may thus be ascertained continuously via change $\Delta\alpha$. The predefined relationship may be calibrated, for example, on a test bench with the aid of the additional analysis of the signal of lambda sensor 15 which is operational for the calibration. In FIG. 6, curve 505 of substitute value $\lambda_e$ plotted against change $\Delta\alpha^*$ is drawn using a dashed line and curve 500 of substitute value $\lambda_e$ plotted against change $\Delta\alpha$ is drawn using a solid line.

For SW2$\leqq\Delta\alpha\leqq$SW1, substitute value $\lambda_e$=1, just as for SW2$\leqq\Delta\alpha^*\leqq$SW1.

For $\Delta\alpha<$SW2, curve 500 of substitute value $\lambda_e$ rises with decreasing $\Delta\alpha$.

For $\Delta\alpha>$SW1, curve 500 of substitute value $\lambda_e$ drops with increasing $\Delta\alpha$.

For $\Delta\alpha^*<$SW2, curve 505 of substitute value $\lambda_e$ drops with decreasing $\Delta\alpha^*$.

For $\Delta\alpha^*>$SW1, curve 505 of substitute value $\lambda_e$ rises with increasing $\Delta\alpha^*$.

Substitute value $\lambda_e$ is supplied to first correction unit 125 in each case. Second correction unit 150 transmits a trigger signal to first correction unit 125 at second point in time $t_2$ and at third point in time $t_3$. First correction unit 125 then compares substitute value $\lambda_e$ received after the trigger signal at second point in time $t_2$ to substitute value $\lambda_e$ received after the trigger signal at third point in time $t_3$. If, at second point in time $t_2$ and at third point in time $t_3$, the two substitute values $\lambda_e$ differ from each other by more than a predefined tolerance interval, which has been calibrated, for example, on a test bench to take into account measuring inaccuracies, first correction unit 125 detects an error or an interference in ascertaining substitute value $\lambda_e$ and outputs an appropriate error signal F for further processing, for example, for visual and/or acoustic reproduction, or for saving in an error memory (not illustrated). However, if first correction unit 125 recognizes that the two substitute values $\lambda_e$ do not differ from each other at second point in time $t_2$ and third point in time $t_3$, or differ at most by a predefined tolerance interval, no error is recognized and, instead, correction injection period $t_k$ is set. From point in time t=0 to third point in time $t_3$, correction injection period $t_k$=0. In the event of an error-free ascertainment of substitute value $\lambda_e$, first correction unit 125 compares substitute value $\lambda_e$ existing at third point in time $t_3$ to predefined value $\lambda_{setpoint}$ for the air/fuel mixture ratio. If $\lambda_e$ is greater than $\lambda_{setpoint}$, first correction unit 125 increases correction injection period $t_k$ by a predefined increment shortly after third point in time $t_3$, which may be suitably calibrated, for example, on a test bench. The increment is calibrated, for example, in such a way that, on the one hand, it is not excessively high in order to achieve the most accurate possible regulation of the air/fuel mixture ratio and, on the other hand, it is selected not excessively low in order to achieve the most rapid possible regulation of the air/fuel mixture ratio. However, if first correction unit 125 establishes that substitute value $\lambda_e$ prevailing at third point in time $t_3$ is equal to 1, correction injection period $t_k$ remains at value zero also after third point in time $t_3$. However, if first correction unit 125 establishes that substitute value $\lambda_e$ prevailing at third point in time $t_3$ is less than 1, correction injection period $t_k$ drops briefly after third point in time $t_3$ from value zero by a predefined decrement, whose absolute value may be equal to the predefined increment, for example, so that $t_k$ is negative.

In this way, a regulation of the air/fuel mixture ratio is achieved with the aid of substitute value $\lambda_e$. In the event of an excessively lean mixture compared to predefined value $\lambda_{setpoint}$, i.e., $\lambda_e>\lambda_{setpoint}$, the resulting injection period $t_r$ is thus increased, and in the event of an excessively rich air/fuel mixture ($\lambda_e<\lambda_{setpoint}$) compared to predefined value $\lambda_{setpoint}$ of the air/fuel mixture ratio, the resulting injection period $t_r$ is reduced.

After correction injection period $t_k$ having been predefined at a point in time $t'_3$ briefly following third point in time $t_3$, preferably immediately after third point in time $t_3$, second correction unit 150 waits again from point in time $t'_3$ on for the second predefined waiting period $t_{w2}$, after the elapse of which a fourth point in time $t_4$ is reached. At fourth point in time $t_4$ it may be assumed that the change in instantaneous position $\alpha$ of throttle valve 5, caused by a possible change in correction injection period $t_k$ at point in time $t'_3$, has been settled again, so that the above-described method may be repeated starting at fourth point in time $t_4$, the sequence described from first point in time $t_1$ to point in time $t'_3$ being repeated starting at fourth point in time $t_4$. The above-described method may be repeated until third comparator unit 145 outputs a set signal at its output again because instantaneous engine temperature T has reached temperature threshold value TSW and the cold start of gasoline engine 1 has thus been terminated. The above-described method is also terminated if the idling regulation is no longer active or if another setpoint value nsetpoint is to be predefined for the idling regulation. In this case, change $\Delta\alpha$ in the position of the throttle valve is no longer a function only of the change in additional injection period $t_z$, so that the ascertainment of substitute value $\lambda_e$ becomes unreliable.

Figure 3:
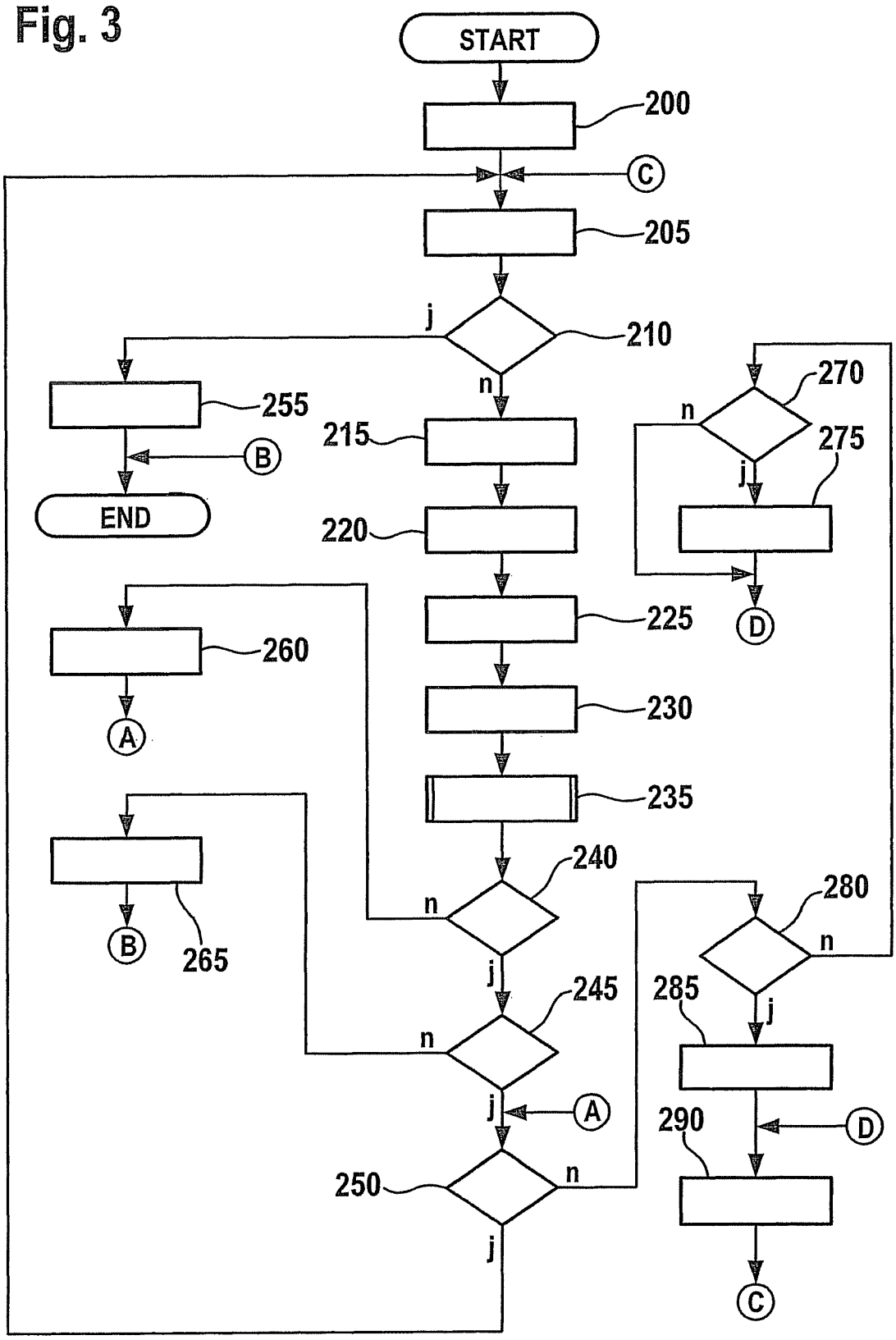
FIG. 3 shows a first flow chart of an example sequence of a method according to the present invention.

FIG. 3 shows a flow chart for an example sequence of a method according to the present invention. After the start of the program, for example, by starting gasoline engine 1, at a program point 200 a memory value $\lambda_{memory}$ for the air/fuel mixture ratio and a run counter are each initialized at value zero, i.e., $\lambda_{memory}$=0 and run counter=0. Furthermore, at program point 200, predefined value $\lambda_{setpoint}$ for the air/fuel mixture ratio is predefined, for example, at value 1 as stoichiometric air/fuel mixture ratio. Program point 200 takes place between time t=0 and first point in time $t_1$. Therefore, at program point 200, basic injection period $t_g$ is also set according to predefined value $\lambda_{setpoint}$ for the air/fuel mixture ratio as a function of setpoint value $\alpha_{setpoint}$ for the position of throttle valve 5, basic injection period $t_g$ having been settled at first point in time $t_1$. Program point 200 is therefore preferably performed at a point in time t with $0<t<t_1$, at which basic injection period $t_g$ has been settled at a steady-state value. The program then branches off to a program point 205.

At program point 205, instantaneous engine temperature T is detected and the run counter is incremented by 1, i.e., run counter=run counter+1. Program point 205 also takes place still before first point in time $t_1$ is reached. The program then branches off to a program point 210.

At program point 210, the third comparator unit checks whether instantaneous engine temperature T is greater than or equal to temperature threshold value TSW. If this is the case, the program branches off to a program point 255; otherwise the program branches off to a program point 215.

At program point 215, immediately before first point in time $t_1$, the settled first instantaneous position $\alpha$1 of throttle valve 5 is ascertained. The program then branches off to a program point 220.

At program point 220, at first point in time $t_1$, second correction unit 150 causes additional injected quantity $t_z$ to increase to predefined value $t_{z1}$. The program then branches off to a program point 225.

At program point 225, immediately before second point in time $t_2$, settled second instantaneous position $\alpha$2 of throttle valve 5 is ascertained. The program then branches off to a program point 230.

At program point 230, at second point in time $t_2$, the difference $\Delta\alpha=\alpha 2-\alpha 1$ is ascertained. The program then branches off to a program point 235.

Figure 4:
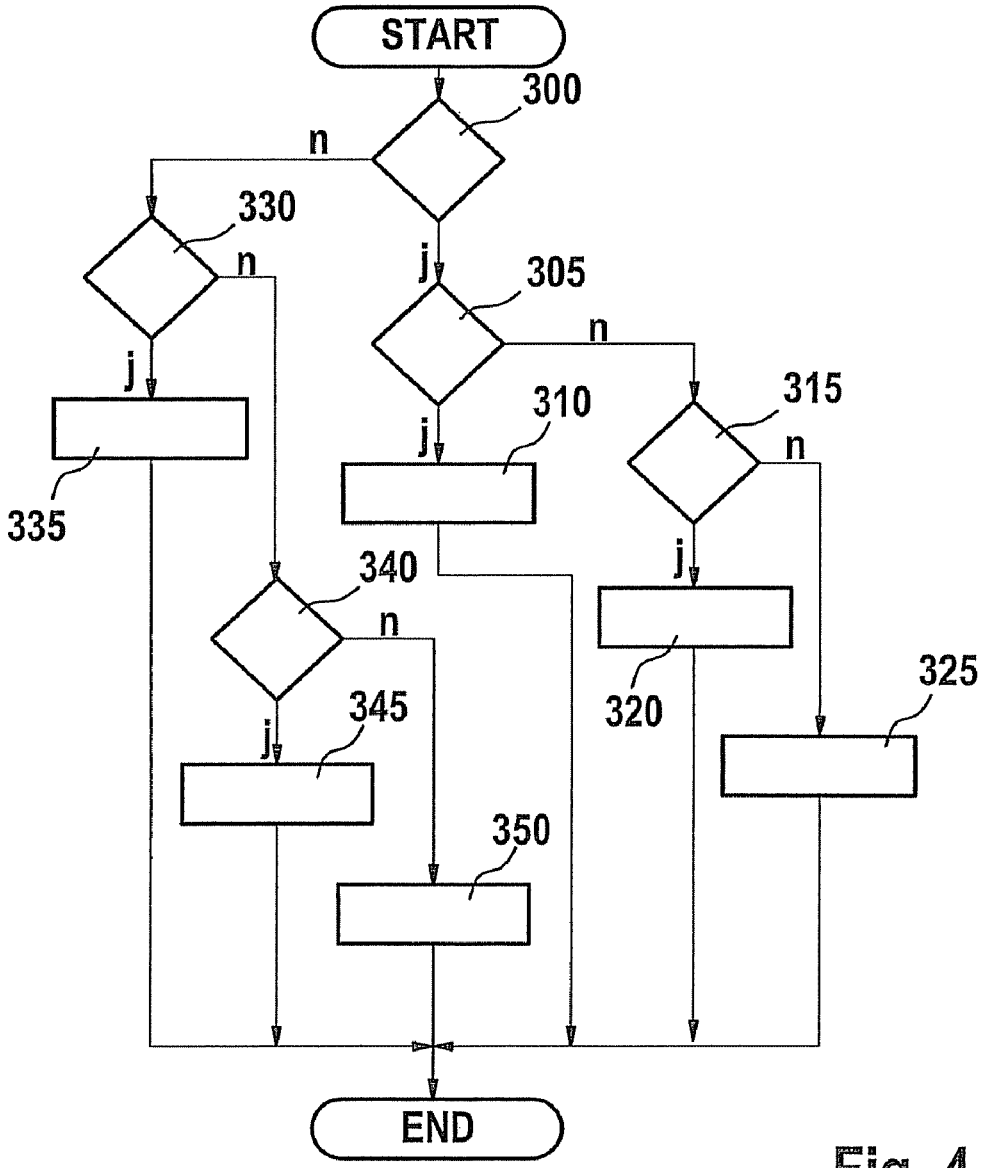
FIG. 4 shows a second flow chart of an example sequence of a method according to the present invention.

At program point 235, between second point in time $t_2$ and point in time $t_{2'}$, substitute value $\lambda_e$ is ascertained in second ascertaining unit 45 according to a subprogram whose sequence is illustrated in FIG. 4 as an example. The program then branches off to a program point 240.

At program point 240 a check is made as to whether memory value $\lambda_{memory}$ for the air/fuel mixture ratio is different from zero. If this is the case, the program branches off to a program point 245; otherwise the program branches off to a program point 260.

At program point 245 a check is made as to whether memory value $\lambda_{memory}$ is equal to substitute value $\lambda_e$ within the predefined tolerance interval. If this is the case, the program branches off to a program point 250; otherwise the program branches off to a program point 265.

At program point 250 a check is made as to whether the run counter is less than or equal to a predefined threshold value. If this is the case, the program branches back to a program point 205; otherwise the program branches off to a program point 280.

At program point 280 a check is made in first correction unit 125 as to whether memory value $\lambda_{memory}$ is greater than setpoint value $\lambda_{setpoint}$ for the air/fuel mixture ratio. If this is the case, the program branches off to a program point 285; otherwise the program branches off to a program point 270.

At program point 285, correction injection period $t_k$ is increased by the increment value. The program then branches off to a program point 290.

At program point 290, memory value $\lambda_{memory}$ and the run counter are each reset to zero, so that $\lambda_{memory}=0$ and run counter=0. The program then branches back to a program point 205.

At program point 270, first correction unit 125 checks whether memory value $\lambda_{memory}$ is less than setpoint value $\lambda_{setpoint}$ for the air/fuel mixture ratio. If this is the case, the program branches off to a program point 275; otherwise the program branches off to program point 290.

At program point 275, correction injection period $t_k$ is reduced by first correction unit 125 by the predefined decrement. The program then branches off to program point 290.

At program point 255, the output of third comparator unit 145 is set and a lambda control is performed on the basis of the now operational lambda sensor 15 in a conventional manner. The program is then terminated.

At program point 260, memory value $\lambda_{memory}$ is overwritten with ascertained substitute value $\lambda_e$. The program then branches off to program point 250.

At program point 265, an error is detected in ascertaining substitute value $\lambda_e$ and error signal F is generated. The program is then terminated. Each repeat run of the program ascertains the corresponding values with a delay by the predefined second waiting period $t_{W2}$ with respect to when these values were ascertained during the previous run of the program. The predefined threshold value for the run counter is greater than or equal to 2, so that at least two runs of the program are ensured until third point in time $t_3$, thus making an error detection possible.

Predefined waiting periods $t_{W1}$, $t_{W2}$ are calibrated on a test bench, for example. First predefined waiting period $t_{W1}$ may be, for example, a few seconds, for example, 10 s, or several minutes; second predefined waiting period $t_{W2}$ may be, for example, a few seconds, for example, 10 s.

FIG. 4 shows a flow chart of an example sequence for ascertaining substitute value $\lambda_e$ according to the subprogram at program point 235 according to FIG. 3. The subprogram according to FIG. 4 runs in second ascertaining unit 45. After the start of the subprogram called in program point 235 of FIG. 3, second ascertaining unit 45 checks, at a program point 300, whether additional injection period $t_z$ was previously increased. For this purpose, additional injection period $t_z$ is supplied by second correction unit 150 also to second ascertaining unit 45. If this is the case, i.e., if additional injection period $t_z$ was previously increased, the program branches off to a program point 305; otherwise, i.e., if additional injection period $t_z$ was previously reduced, the program branches off to a program point 330.

At program point 305, second ascertaining unit 45 checks whether $\Delta\alpha$ is less than second predefined threshold value SW2. If this is the case, the program branches off to a program point 310; otherwise the program branches off to a program point 315.

At program point 310, second ascertaining unit 45 establishes that prior to increasing additional injection period $t_z$, the air/fuel mixture ratio prevailing in combustion chamber 155 was lean. Second ascertaining unit 45 thus sets substitute value $\lambda_e$ at a value greater than 1 at program point 310. Subsequently the subprogram is terminated and the main program is resumed at program point 240.

At program point 315, second ascertaining unit 45 checks whether $\Delta\alpha$ is greater than first predefined threshold value SW1. If this is the case, the program branches off to a program point 320; otherwise the program branches off to a program point 325.

At program point 320, second ascertaining unit 45 recognizes that prior to the latest increase in additional injection period $t_z$, the air/fuel mixture ratio prevailing in combustion chamber 155 was rich and sets substitute value $\lambda_e$ at a value less than 1. Subsequently the subprogram is terminated and the main program is resumed at program point 240.

At program point 325, second ascertaining unit 45 establishes that, prior to the latest increase in additional injection period $t_z$, the air/fuel mixture ratio prevailing in combustion chamber 155 was stoichiometric and sets substitute value $\lambda_e$ at the value 1. Subsequently the subprogram is terminated and the main program is continued at program point 240.

At program point 330, second ascertaining unit 45 checks whether $\Delta\alpha^*$ is greater than first predefined threshold value SW1. If this is the case, the program branches off to a program point 335; otherwise the program branches off to a program point 340.

At program point 335, second ascertaining unit 45 recognizes that prior to the latest reduction in additional injection period $t_z$, the air/fuel mixture ratio prevailing in combustion chamber 155 was lean and sets expected value $\lambda_e$ at a value greater than 1. Subsequently the subprogram is terminated and the main program is continued at program point 240.

At program point 340 second ascertaining unit 45 checks whether $\Delta\alpha^*<$SW2. If this is the case, the program branches off to a program point 345; otherwise the program branches off to a program point 350.

At program point 345, second ascertaining unit 45 establishes that prior to the latest reduction in additional injection period $t_z$, the air/fuel mixture ratio prevailing in combustion chamber 155 was rich and sets substitute value $\lambda_e$ at a value less than 1. Subsequently the subprogram is terminated and the main program is continued at program point 240.

At program point 350, second ascertaining unit 45 establishes that prior to the latest reduction in additional injection period $t_z$, the air/fuel mixture ratio prevailing in combustion chamber 155 was stoichiometric and sets substitute value $\lambda_e$ at the value 1. Subsequently the subprogram is terminated and the main program is continued at program point 240.

In general, according to the example embodiment of the present invention, a check is made on the basis of the change in the additional injection period $t_z$ or in general of a change in the fuel quantity to be injected in relation to the air quantity to be supplied to the internal combustion engine as to whether this causes a change in a first quantity of the internal combustion engine which allows a conclusion to be drawn about the behavior of an output quantity of internal combustion engine 1, in particular of a torque or a power output of internal combustion engine 1. Depending on the change in the first quantity of internal combustion engine 1, a value is ascertained for the air/fuel mixture ratio prevailing in combustion chamber 155 prior to the change in the fuel quantity to be injected, i.e., the air/fuel mixture ratio for the fuel quantity to be injected associated with basic injection period $t_g$, or the basic injection quantity $t_g+t_k$ corrected by the correction injection period. The change in the first quantity of internal combustion engine 1 may be obtained in an advantageous and easy-to-evaluate manner in connection with an idling regulation as illustrated in FIG. 2 by reference numeral 90. In the example embodiment of FIG. 2, the instantaneous position $\alpha$ of throttle valve 5 is used as an example of the first quantity of internal combustion engine 1. Additionally or alternatively, the ignition angle or the ignition angle efficiency may also be used as the first quantity. The ignition angle efficiency provides the relationship between an instantaneous ignition angle and an ignition angle that is optimum for the combustion, for example, in the form of a quotient between the instantaneous ignition angle and the ignition angle that is optimum for the combustion. If the increase in additional injection period $t_z$ at first point in time $t_1$ results in a displacement of the ignition angle in the direction of advance or in an increase in the ignition angle efficiency, i.e., in the instantaneous ignition angle approaching the ignition angle that is optimum for the combustion, in this case second ascertaining unit 45 analyzes the change in the ignition angle and recognizes that the air/fuel mixture ratio was lean prior to the increase in additional injection period $t_z$. In the case of a retarded ignition angle recognized by second ascertaining unit 45 or a reduction in the ignition angle efficiency, i.e., the instantaneous ignition angle moving farther away from the ignition angle that is optimum for the combustion due to the increase in the additional injection period $t_z$, second ascertaining unit 45 recognizes that the air/fuel mixture ratio prevailing in combustion chamber 155 was rich prior to the increase in the additional injection period $t_z$. However, if the ignition angle is displaced due to the increase in additional injection period $t_z$ only insignificantly within predefined tolerance limits, second ascertaining unit 45 recognizes that the air/fuel mixture ratio in combustion chamber 155 was stoichiometric prior to the increase in additional injection period $t_z$.

Additionally or alternatively to evaluating the instantaneous position of throttle valve 5 or of the displacement of the ignition angle, the output quantity of internal combustion engine 1 may also be measured directly, for example, with the aid of a torque sensor, in a conventional manner, or may be modeled from other performance quantities of internal combustion engine 1 in a conventional manner. Signal $p_B$ of combustion chamber pressure sensor 75 may also provide indications about the behavior of the output quantity of internal combustion engine 1. A conclusion about the behavior of the output quantity of the internal combustion engine may be drawn from the signal of combustion chamber pressure sensor 75, i.e., from the variation of combustion chamber pressure $p_B$ over time. With the aid of signal $p_B$ of combustion chamber pressure sensor 75 or of signal M of torque sensor 145, a conclusion may be drawn that the torque or the power output of internal combustion engine 1 has increased due to the increase in the additional injection period $t_z$; second ascertaining unit 45 thus recognizes that the air/fuel mixture ratio prevailing in combustion chamber 155 prior to the increase in additional injection period $t_z$ was lean. If, on the basis of the signal of torque sensor 165 or the signal of combustion chamber pressure sensor 75, second ascertaining unit 45 recognizes a reduction of the torque or of the power output of the internal combustion engine due to the increase in the additional injection period $t_z$, it recognizes that the air/fuel mixture ratio prevailing in combustion chamber 155 prior to the increase in additional injection period $t_z$ was rich. If, on the basis of the signal of torque sensor 165 or combustion chamber pressure sensor 75, second ascertaining unit 45 recognizes no substantial change in the torque or in the power output of the internal combustion engine, i.e., only a change in a predefined tolerance range around the value 0, due to the increase in the additional injection period $t_z$, second ascertaining unit 45 recognizes that the air/fuel mixture ratio prevailing in combustion chamber 155 prior to the increase in additional injection period $t_z$ was stoichiometric.

If, on the basis of the signal of torque sensor 165 or the signal of combustion chamber pressure sensor 75, second ascertaining unit 45 recognizes a reduction in the torque or in the power output of the internal combustion engine in the case of a prior reduction in additional injection period $t_z$, it recognizes that the air/fuel mixture ratio prevailing in combustion chamber 155 prior to the reduction in additional injection period $t_z$ was lean. If, however, on the basis of the signal of torque sensor 165 or of combustion chamber pressure sensor 75, second ascertaining unit 45 recognizes an increase in the torque or in the power output of internal combustion engine 1 due to the reduction in additional injection period $t_z$, it recognizes that the air/fuel mixture ratio prevailing in combustion chamber 155 prior to the reduction in additional injection period $t_z$ was rich. If, on the basis of the signal of torque sensor 165 or combustion chamber pressure sensor 75, second ascertaining unit 45 recognizes no substantial change in the torque or of the power output of internal combustion engine 1, i.e., only a change in the torque or of the power output of internal combustion engine 1 in a predefined tolerance range around the value 0, due to the reduction in the additional injection period $t_z$, second ascertaining unit 45 recognizes that the air/fuel mixture ratio prevailing in combustion chamber 155 prior to the reduction in additional injection period $t_z$ was stoichiometric.

To ascertain substitute value $\lambda_e$ for the air/fuel mixture ratio, the smooth running of internal combustion engine 1 may also be used, which may be determined in a conventional manner, for example, from the rotational speed of internal combustion engine 1. In the event of highly smooth running, due to the change in the additional injection period $t_z$, over a threshold value calibrated on a test bench by analyzing an air/fuel mixture ratio measured by lambda sensor 15 during the calibration, a stoichiometric air/fuel mixture ratio prevailing in combustion chamber 155 prior to the change in additional injection period $t_z$ may be assumed and $\lambda_e=1$ may be set. Otherwise the air/fuel mixture ratio in combustion chamber 155 was in the rich or lean range prior to the change in additional injection period $t_z$. A more accurate determination of substitute value $\lambda_e$ is not possible in this case.

Smooth running, just as the position of throttle valve 5, the ignition angle, the ignition angle efficiency, the torque, the power output, and the combustion chamber pressure, represents a quantity which allows a conclusion to be drawn about the behavior of an output quantity of internal combustion engine 1, for example, the torque or the power output. During calibration, the threshold value for smooth running is selected in such a way that lambda sensor 15 ascertains a lambda value for a stoichiometric air/fuel mixture ratio only for smooth running values greater than the threshold value.

The above-described widened opening of throttle valve 5 or retard of the ignition angle corresponds to a reduction in the output quantity of the internal combustion engine, i.e., to a reduction in the torque or the power output of internal combustion engine 1. In contrast, a movement of throttle valve 5 in the closing direction or a displacement of the ignition angle in the direction of advance corresponds to an increase in the torque or the power output of the internal combustion engine and thus of the output quantity of internal combustion engine 1.

As a condition for the presence of the cold start, a time monitoring, in addition or as an alternative to temperature monitoring, may also be performed, the time elapsed since the start of the internal combustion engine being compared to a predefined time. If the elapsed time reaches the predefined time, the end of the cold start is recognized. The predefined time is calibrated, for example, on a test bench, in such a way that it is ensured that lambda sensor 15 is operational after the predefined time has elapsed since the start of the internal combustion engine.

Additionally or alternatively, the presence of the cold start may also be ascertained with the aid of an operational readiness signal of lambda sensor 15. As soon as the lambda sensor reports being operational by emitting an operational readiness signal, the end of the cold start is recognized and the lambda regulation is performed no longer on the basis of substitute value $\lambda_e$ but on the basis of the lambda value ascertained by lambda sensor 15. Similar reasoning applies to the alternatives for the cold start detection as long as the predefined time has not yet been reached. After the elapse of the predefined time, the system switches over from lambda regulation on the basis of substitute value $\lambda_e$ to lambda regulation on the basis of the lambda signal of lambda sensor 15.

The example method according to the present invention may also be performed in internal combustion engines which have no lambda sensor at all, so that the above-described method and the above-described device perform lambda regulation on the basis of substitute value $\lambda_e$ even outside the cold start of the internal combustion engine.

When, as the air/fuel mixture ratio in combustion chamber 155 is enriched by increasing the additional injection period $t_z$ of idling controller 90, throttle valve 5 moves in the closing direction and, as the air/fuel mixture ratio in combustion chamber 155 is made leaner by reducing the additional injection period $t_z$, throttle valve 5 moves in the opening direction, so without the additional injection period $t_z$ the air/fuel mixture ratio is on the lean side. Increasing additional injection period $t_z$ then results in a higher torque of internal combustion engine 1. If, however, the response is reversed, i.e., when additional injection period $t_z$ is increased, idling controller 90 operates throttle valve 5 in the opening direction and when additional injection period $t_z$ is reduced, the throttle valve is operated in the closing direction, so without additional injection period $t_z$ the air/fuel mixture ratio in combustion chamber 155 is rich and the additional injection period $t_z$ results in a lower torque of internal combustion engine 1, since the air/fuel mixture ratio is then excessively rich.

The ignition angle efficiency may also be computed as the ratio of the torque output by the internal combustion engine at the instantaneous ignition angle in relation to the torque output by internal combustion engine 1 at the optimum ignition angle. At the optimum ignition angle, the efficiency of internal combustion engine 1 is the highest.

Put more precisely, the ignition angle efficiency indicates to what percentage of the indicated torque of internal combustion engine 1 it has dropped in the high-pressure phase of the cylinder(s) compared to the value at optimum ignition angle.

The relationship between a closing throttle valve 5 and an increase in the torque or the power output of internal combustion engine 1 applies only in the case of the idling regulation discussed as an example. Without idling regulation or outside idling, the example method according to the present invention is possible by directly measuring the torque with the aid of torque sensor 165 or by indirectly ascertaining the torque or the power output of internal combustion engine 1, for example, with the aid of combustion chamber pressure sensor 75, however, not by evaluating the position of throttle valve 5 or the ignition angle. The idling regulation is not absolutely necessary for ascertaining substitute value $\lambda_e$ of the air/fuel mixture ratio according to the present invention, i.e., setpoint value αsetpoint may be defined in a different manner than by an idling controller, for example, as the output quantity of a velocity controller or for implementing a driver's input; in this case, the driver's input should be constant over time, if possible, for ascertaining substitute value $\lambda_e$ according to the present invention. Otherwise, reliable ascertainment of substitute value $\lambda_e$ for the air/fuel mixture ratio is not ensured.

Additionally or alternatively to setpoint value αsetpoint, idling controller 90 may also output a setpoint value for the ignition angle, so that in this way an evaluation, similar to the one described above, of the ignition angle for retard or advance may be performed in view of ascertaining substitute value $\lambda_e$ for the air/fuel mixture ratio as described above. By modifying additional injection period $t_z$, in the case of a non-stoichiometric air/fuel mixture ratio in combustion chamber 155, a change in setpoint value $\alpha_{setpoint}$ or of the ignition angle is necessary in order to maintain the desired setpoint rotational speed nsetpoint in the case of the idling controller or a desired vehicle velocity in the case of the velocity controller or a certain driver's input in the case of operating the accelerator pedal. By analyzing these changes, which are also reflected in the change in the torque output by internal combustion engine 1 or the power output by internal combustion engine 1, substitute value $\lambda_e$ for the air/fuel mixture ratio is ascertained as described above.

For the case where no lambda sensor is installed in the exhaust tract, the air/fuel mixture ratio ascertained during idling or, during activated idling regulation, may be applied to the entire load/rotational speed range of the internal combustion engine. This application may be used, for example, in a very small engine, in a low-cost system without lambda sensor 15, and possibly also without regulation of the air/fuel mixture ratio, for example, in a motorcycle or in a low-priced vehicle.

The example method according to the present invention is also suitable for engines running at constant, regulated speed, such as, for example, power generators, small engines for heat pumps, power saws, or the like. Also in this case, a lambda sensor in the exhaust tract may be omitted if optimum exhaust gas purification is not required.

What is claimed is:

1. A device for operating an internal combustion engine, comparing:

a triggering component which controls an injection of fuel for combustion in a combustion chamber of the internal combustion engine;

a selection component which predefines a first fuel quantity to be injected;

a first ascertaining component which ascertains a first value of the first quantity of the internal combustion engine, which allows a conclusion to be drawn on the behavior of an output quantity of the internal combustion engine, the first ascertaining component adapted to ascertain the first value of the first fuel quantity which results from a fuel injection according to the first fuel quantity to be injected wherein the triggering component is adapted to change the fuel quantity to be injected in relation to an air quantity to be supplied to the internal combustion engine based on the first fuel quantity to be injected, and the first ascertaining component ascertains a second value of the first fuel quantity which results due to a change in the fuel quantity to be injected;

a comparator which compares the first value of the first fuel quantity with the second value of the first fuel quantity; and a second ascertaining component which ascertains, as a function of the comparison result, a value for an air/fuel mixture ratio for the first fuel quantity to be injected prevailing prior to the change in the fuel quantity to be injected, independently of a measured value of a sensor measuring the oxygen level in the exhaust gas.

2. A method for operating an internal combustion engine, comprising:

a) predefining a first fuel quantity to be injected for combustion in a combustion chamber of the internal combustion engine;

b) ascertaining a first value of the first fuel quantity, the first value resulting from a fuel injection according to the first fuel quantity to be injected;

c) modifying a fuel quantity to be injected from the first fuel quantity to be injected in relation to an air quantity to be supplied to the internal combustion engine;

d) ascertaining a second value of the first fuel quantity, the second value resulting from a change in the fuel quantity to be injected;

e) comparing the first value of the first fuel quantity to the second value of the first fuel quantity; and f) ascertaining, independently of a measured value of a sensor measuring the oxygen level in the exhaust gas, a value for an air/fuel mixture ratio for the first fuel quantity to be injected prevailing prior to the change in the fuel quantity to be injected, as a function of a result of the comparing.

3. The method as recited in claim 2, wherein steps a) through f) are performed repeatedly, the first fuel quantity to be injected in step a) being set equal to the fuel quantity to be injected achieved in step c) in a previous performance of steps a) through f).

4. The method as recited in claim 3, wherein an error is detected if, after repeatedly performing steps a) through f) successively, different values for the air/fuel mixture ratio are ascertained without a basic injected quantity having been corrected.

5. The method as recited in claim 3, wherein the ascertained air/fuel mixture ratio is compared with a predefined air/fuel mixture ratio and, depending on a result of the compare, the value of the first fuel quantity to be injected predefined prior to the first performance of steps b) through f) is corrected as a basic injected amount in such a way that the ascertained air/fuel mixture ratio approaches the predefined air/fuel mixture ratio.

6. The method as recited in claim 2, wherein the fuel quantity to be injected is increased in step c) and if in step e) following the increase in the fuel quantity to be injected the comparing shows an increase in an output quantity of the internal combustion engine, a conclusion is drawn that a lean air/fuel mixture ratio prevailed prior to the increase in the fuel quantity to be injected.

7. The method as recited in claim 2, wherein the fuel quantity to be injected is reduced in step c) and, if in step e) following the reduction in the fuel quantity to be injected the comparing shows a reduction in an output quantity of the internal combustion engine, a conclusion is drawn that a lean air/fuel mixture ratio prevailed prior to the increase in the fuel quantity to be injected.

8. The method as recited in claim 2, wherein the fuel quantity to be injected is increased in step c) and, if in step e) following the increase in the fuel quantity to be injected the comparing shows a reduction in an output quantity of the internal combustion engine, a conclusion is drawn that a rich air/fuel mixture ratio prevailed prior to the increase in the fuel quantity to be injected.

9. The method as recited in claim 2, wherein the fuel quantity to be injected is reduced in step c) and, if in step e) following the reduction in the fuel quantity to be injected the comparing shows an increase in an output quantity of the internal combustion engine, a conclusion is drawn that a rich air/fuel mixture ratio prevailed prior to the increase in the fuel quantity to be injected.

10. The method as recited in claim 2, wherein, if in step e) following the change in the fuel quantity to be injected in step c) the comparing shows no change in an output quantity of the internal combustion engine within a predefined tolerance range, a conclusion is drawn that a stoichiometric air/fuel mixture ratio prevailed prior to the increase in the fuel quantity to be injected.

11. The method as recited in claim 2, wherein a position of an actuator is selected as the first fuel quantity of the internal combustion engine, and a movement of the actuator in an opening direction is recognized when the output quantity of the internal combustion engine is reduced.

12. The method as recited in claim 2, wherein one of i) an ignition angle, or ii) an ignition angle efficiency which is a relationship between an instantaneous ignition angle and an ignition angle that is optimum for the combustion, is selected as the first fuel quantity of the internal combustion engine, and an ignition angle retard or a reduction in the ignition angle efficiency is detected when the output quantity of the internal combustion engine is reduced.

13. The method as recited in claim 2, wherein a measured or modeled torque of the internal combustion engine, which corresponds to the output quantity of the internal combustion engine, is selected as the first fuel quantity of the internal combustion engine.

14. The method as recited in claim 2, wherein a quantity characterizing a combustion chamber pressure, is selected as the first fuel quantity of the internal combustion engine, and a change in the output quantity of the internal combustion engine is ascertained as a function of a behavior of the quantity characterizing the combustion.

15. The method as recited in claim 2, wherein the first fuel quantity is set to a predefined value of an idling regulation, within a regulation of a second quantity of the internal combustion engine.

16. The method as recited in claim 2, wherein the air/fuel mixture ratio is ascertained according to steps a) through f) during a cold start of the internal combustion engine, at least as long as a lambda sensor of the internal combustion engine is not operational.

* * * * *